US010605563B2

(12) United States Patent
Hall

(10) Patent No.: US 10,605,563 B2
(45) **Date of Patent: *Mar. 31, 2020**

(54) FIREARM WITH LATERALLY FOLDING FOREARM AND BARREL, AND RELATED METHODS

(71) Applicant: Corby Hall, Henderson, TX (US)

(72) Inventor: Corby Hall, Henderson, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/967,243

(22) Filed: Apr. 30, 2018

(65) Prior Publication Data

US 2018/0252495 A1 Sep. 6, 2018

Related U.S. Application Data

(63) Continuation of application No. 15/480,112, filed on Apr. 5, 2017, now Pat. No. 9,995,556.

(60) Provisional application No. 62/382,320, filed on Sep. 1, 2016.

(51) Int. Cl.

| | |
|---|---|
| ***F41C 7/11*** | (2006.01) |
| ***F41C 23/16*** | (2006.01) |
| ***F41A 5/26*** | (2006.01) |

(52) U.S. Cl.

CPC ..... *F41C 7/11* (2013.01); *F41A 5/26* (2013.01); *F41C 23/16* (2013.01)

(58) Field of Classification Search

CPC ..... F41C 7/11; F41A 11/04
USPC ..... 89/159, 166, 168, 14.05; 42/75.04
See application file for complete search history.

(56) References Cited

U.S. PATENT DOCUMENTS

| | | | | |
|---|---|---|---|---|
| 2,115,861 | A * | 5/1938 | LaLoux | F41A 3/68 42/75.02 |
| 3,318,192 | A * | 5/1967 | Sullivan | F41A 3/26 42/106 |
| 3,996,685 | A * | 12/1976 | Bauman | F41A 9/18 42/17 |
| 4,044,487 | A * | 8/1977 | Hutton | F41A 35/02 42/16 |
| 4,182,065 | A * | 1/1980 | Martensson | F41A 19/54 42/12 |
| 7,143,998 | B1 | 12/2006 | Hall | |
| 8,819,981 | B2 | 9/2014 | Malik et al. | |
| 8,863,637 | B2 | 10/2014 | Hall | |
| 9,146,075 | B2 | 9/2015 | Malik | |
| 9,155,837 | B2 * | 10/2015 | Kemp | A61M 5/2033 |

(Continued)

OTHER PUBLICATIONS

Eger, "4 Foldable Submachine Guns," Guns.com, Febraury 8, 2013, 9 pages, http://www.guns.com/2013/02/02/foldable-submachine-guns/.

(Continued)

*Primary Examiner* — Samir Abdosh
(74) *Attorney, Agent, or Firm* — TraskBritt

(57) ABSTRACT

A firearm includes a receiver, a forearm pivotally attached to a distal end of the receiver, and a barrel having a barrel extension. A proximal end of the barrel and the barrel extension are secured within the forearm such that the barrel and barrel extension are laterally pivotable with the forearm relative to the receiver between a first assembled position and a second folded position. The forearm, barrel, and barrel extension may be secured to the receiver in the first assembled position for use of the firearm, after which the firearm may be folded for storage and/or transportation.

20 Claims, 10 Drawing Sheets

(56) References Cited

U.S. PATENT DOCUMENTS

| | | | | |
|---|---|---|---|---|
| 9,233,214 | B2 * | 1/2016 | Kemp | A61M 5/2033 |
| 9,322,606 | B2 | 4/2016 | Hall | |
| 9,441,909 | B2 | 9/2016 | Malik | |
| 9,476,659 | B2 | 10/2016 | Hall | |
| 9,568,261 | B1 * | 2/2017 | Hall | F41A 3/66 |
| 9,616,181 | B2 * | 4/2017 | Kemp | A61M 5/2033 |
| 9,739,563 | B1 * | 8/2017 | Tharp | F41B 11/70 |
| 2007/0068057 | A1 * | 3/2007 | Macaluso | F41C 7/025 42/105 |
| 2016/0022922 | A1 * | 1/2016 | Kemp | A61M 5/2033 604/198 |
| 2016/0025434 | A1 * | 1/2016 | Karagias | F41A 15/12 42/25 |

OTHER PUBLICATIONS

Hanson, "The Best Takedown/Collapsible Rifle ," Spy Escape and Evasion blog, Apr. 11, 2016, 11 pages, http://spyescapeandevasion.com/blog/author/admin/.

"LaRue PredatOBR In 260 Remington," The Firearm Blog, Sep. 6, 2016, 7 pages, http://www.thefirearmblog.com/blog/2016/09/06/larue-260-rem/.

Operation Manual for Winchester Air Rifle Models 500X/600X/800X/1 OOOX/522X/722X1850X22, published by Daisy Outdoor Products, Feb. 2009 (Year: 2009).

* cited by examiner

FIREARM WITH LATERALLY FOLDING FOREARM AND BARREL, AND RELATED METHODS

CROSS-REFERENCE TO RELATED APPLICATION

This application is a continuation application of U.S. patent application Ser. No. 15/480,112, filed Apr. 5, 2017, which claims the benefit of U.S. Provisional Patent Application Ser. No. 62/382,320, filed Sep. 1, 2016, the disclosures of which are incorporated herein in their entireties by this reference.

TECHNICAL FIELD

The present disclosure relates to a folding firearm, and more particularly to a firearm having a barrel configured to be selectively folded relative to a receiver or action to which the barrel is attached, and to methods of manufacturing and using such a firearm.

BACKGROUND

Conventional firearms including a barrel that is threaded to a receiver that houses the action. Within the civilian, law enforcement, and military firearms community there exists a need and demand for compact semi-automatic sniper system firearms, especially with respect to precision auto-loading firearms that are capable of being collapsed down into a manageable size during transport and storage. Thus, firearms have been developed that have a stock that can be folded relative to the receiver for storage and transport. These existing foldable stock designs allow reduction of the overall firearm length by approximately 8-inches on an AR-style firearm.

BRIEF SUMMARY

This summary is provided to introduce a selection of concepts in a simplified form. These concepts are described in further detail in the detailed description of example embodiments of the disclosure below. This summary is not intended to identify key features or essential features of the claimed subject matter, nor is it intended to be used to limit the scope of the claimed subject matter.

In some embodiments, the present disclosure includes a firearm comprising a receiver, a forearm pivotally attached to a distal end of the receiver, and a barrel having a barrel extension. A proximal end of the barrel and barrel extension are secured within the forearm such that the barrel and barrel extension are pivotable with the forearm relative to the receiver between a first assembled position and a second folded position. The firearm includes a locking mechanism for securing the forearm, barrel, and barrel extension to the receiver in the first assembled position. The barrel is not secured to the receiver by complementary threads.

In additional embodiments, the present disclosure includes methods of using such a firearm. The forearm, barrel, and barrel extension may be secured to the receiver in the first assembled position using the locking mechanism, and one or more rounds of ammunition may be fired using the firearm. The locking mechanism may be unlocked, and the forearm, barrel, and barrel extension may be folded relative to the receiver from the first assembled position to the second folded position.

In yet further embodiments, the present disclosure includes a method of manufacturing a firearm. A receiver, barrel, and barrel extension are provided. A proximal end of the barrel and the barrel extension are secured to a forearm, and the forearm is pivotally attached to a distal end of the receiver, such that the barrel and barrel extension are pivotable with the forearm relative to the receiver between a first assembled position and a second folded position. A locking mechanism is included for securing the forearm, barrel, and barrel extension to the receiver in the first assembled position.

DETAILED DESCRIPTION

The illustrations presented herein are not meant to be actual views of any particular firearm or component thereof, but are merely idealized representations that are used to describe embodiments of the disclosure.

As used herein, the term "proximal," when used in relation to a firearm or component of a firearm, means proximate or nearer to a user of the firearm or component of a firearm when the user is holding the firearm in a shooting position. As used herein, the term "distal," when used in relation to a firearm or component of a firearm, means remote or farther from a user of the firearm or component of a firearm when the user is holding the firearm in a shooting position.

As used herein, the term "firearm" means and includes both a complete firearm, as well as what is referred to in the industry as an "upper" of an AR-style firearm, which includes an upper receiver and a barrel connected to the upper receiver. Uppers are often commercially sold without the lower receiver, trigger, magazine, and stock. The upper receiver may or may not include a bolt carrier group. Thus, an upper receiver (with or without a bolt carrier group) with a barrel coupled to the upper receiver is considered to be a firearm for purposes of the present application.

As used herein, the term "receiver" means and includes any the part of a firearm that houses the operating parts, and includes, but is not limited to, the housing of the action of a bolt action firearm, the upper and/or lower housing of an AR-style autoloading firearm, and the housing for the action components of other styles of autoloading firearms.

Embodiments of the present disclosure are described in detail herein with respect to an AR-style autoloading firearm, but the present disclosure may be similarly applied to any other style of firearm. In addition, embodiments of the present disclosure may allow all levers and mechanisms used in the system to remain secured in place while the firearm is either in the folded configuration or the unfolded configuration. In addition, firearms of the present disclosure may allow the firearm to be repeatedly folded and unfolded and secured in the unfolded, operational configuration in a manner that does not require tools.

Figure 1:
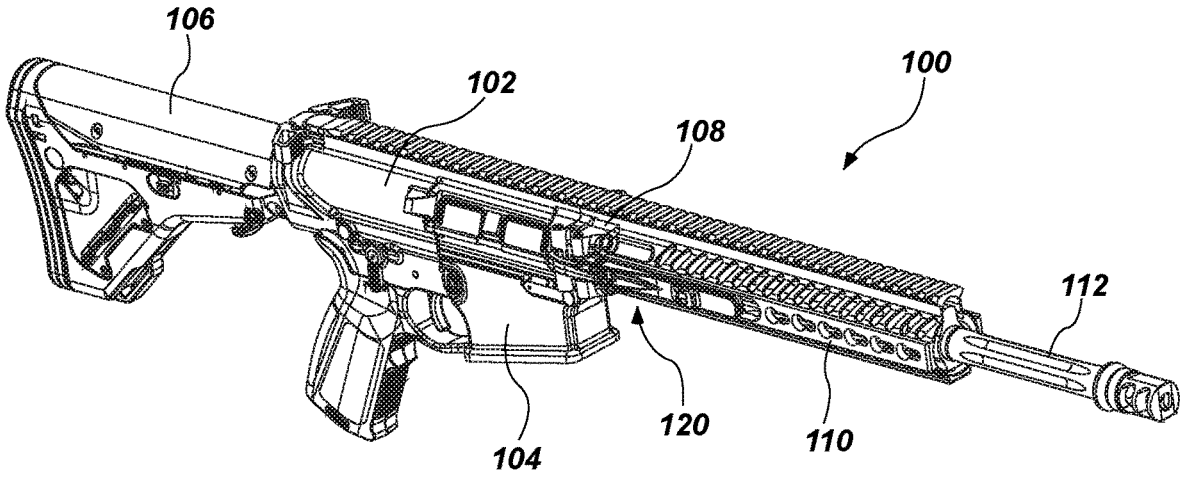
FIG. 1 is a perspective view of an embodiment of an AR-style firearm of the present disclosure in an unfolded, operational configuration.

FIG. 1 illustrates an example embodiment of an AR-style firearm 100 of the present disclosure. The firearm 100 includes an upper receiver 102, a lower receiver 104, a stock 106, a forearm 108, a handgaurd 110, and a barrel 112. The handgaurd 110 may be secured to the forearm 108, and may extend over and around at least a portion of the barrel 112. As disclosed in further detail below, the forearm 108 is pivotally attached to a distal end of the upper receiver 102. The barrel 112 has a barrel extension 114 (FIG. 3), and a proximal end of the barrel 112 and the barrel extension 114 are secured within the forearm 108 such that the barrel 112 and barrel extension 114 are pivotable with the forearm 108 relative to the upper receiver 102 between a first assembled position shown in FIG. 1, and a second folded position shown in FIGS. 2 and 3. The firearm 100 is in the folded configuration for storage and/or transportation when the forearm 108, barrel 112, and barrel extension 114 are in the second folded position of FIGS. 2 and 3. The firearm 100 is in the unfolded, operational configuration when the forearm 108, barrel 112, and barrel extension 114 are in the first assembled position of FIG. 1.

The firearm 100 further includes a locking mechanism 140 for securing the forearm 108, barrel 112, and barrel extension 114 to the upper receiver 102 in the first assembled position of FIG. 1, as described in further detail below.

Figure 2:
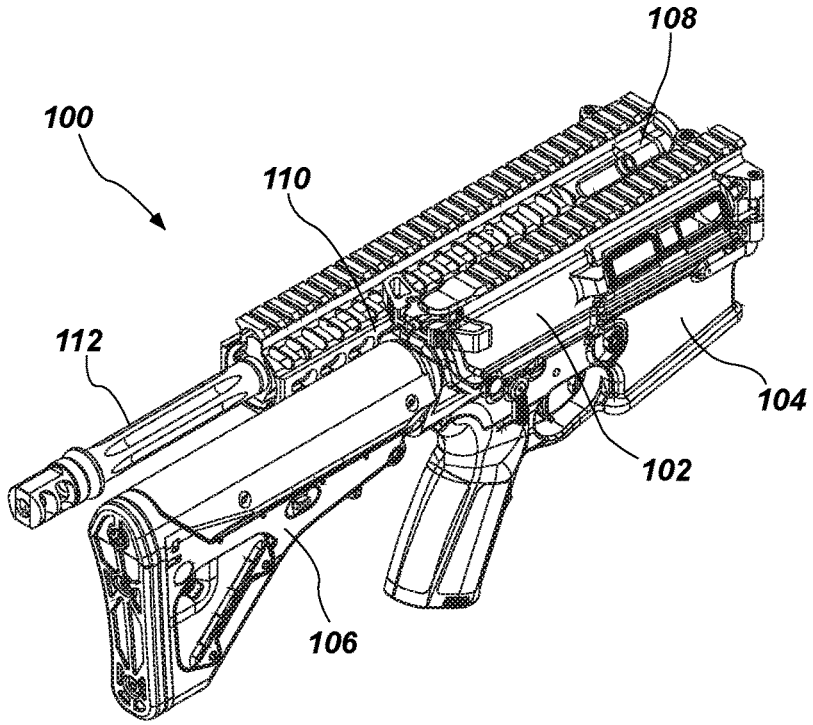
FIG. 2 is a perspective view of the firearm of FIG. 1 in a folded configuration for storage and/or transportation.
Figure 3:
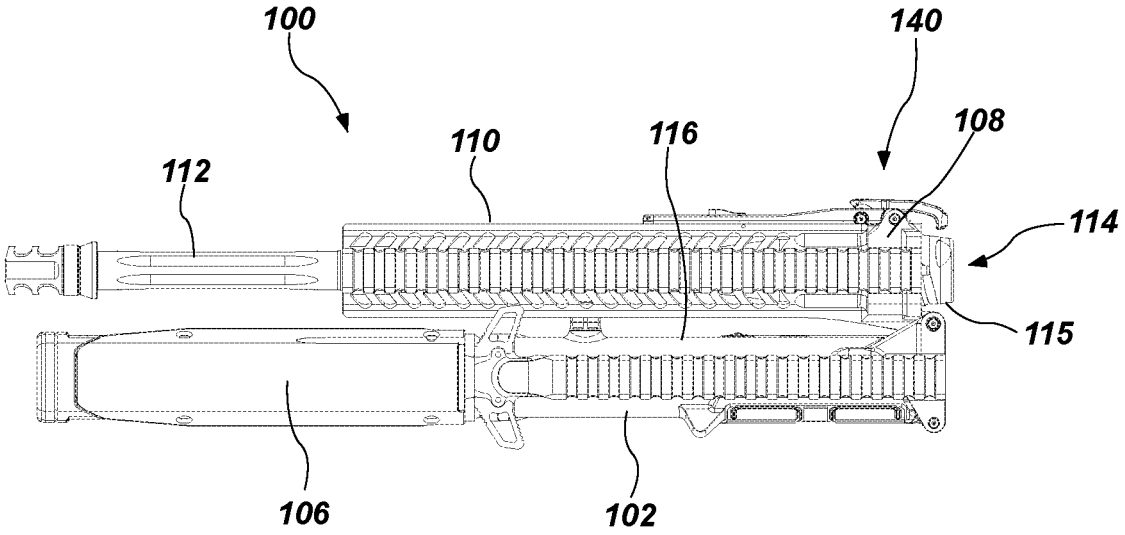
FIG. 3 is a top view of the firearm in the folded configuration of FIG. 2.

As can be seen in FIG. 3, embodiments of the present disclosure allow the firearm 100 to be folded at a location proximate to the junction between the barrel 112 and the upper receiver 102 such that at least a portion of the barrel 112 is disposed laterally adjacent a lateral exterior side surface 116 of the upper receiver 102 when the forearm 108, barrel 112, and barrel extension 114 are in the second folded position of FIGS. 2 and 3. For example, the present disclosure may enable an AR-10 style firearm having a barrel length of approximately eighteen (18) inches and an overall length of approximately thirty-five (35) inches to be folded nearly in half, so as to have an overall length of about nineteen (19) inches, which is a reduction in length of approximately sixteen (16) inches.

With continued reference to FIG. 3, the barrel extension 114 projects outwardly in the proximal direction (when the firearm 100 in the assembled configuration of FIG. 1) from a proximal end of the forearm 108. In some embodiments, the barrel 112 and barrel extension 114 may comprise discrete components that are separately formed and subsequently assembled and secured together. For example, the barrel 112 and barrel extension 114 may be threaded together, and secured within the forearm 108 using set screws 113 (FIG. 9), for example. In other embodiments, however, the barrel extension 114 may comprise an integral portion of the barrel 112.

Figure 4:
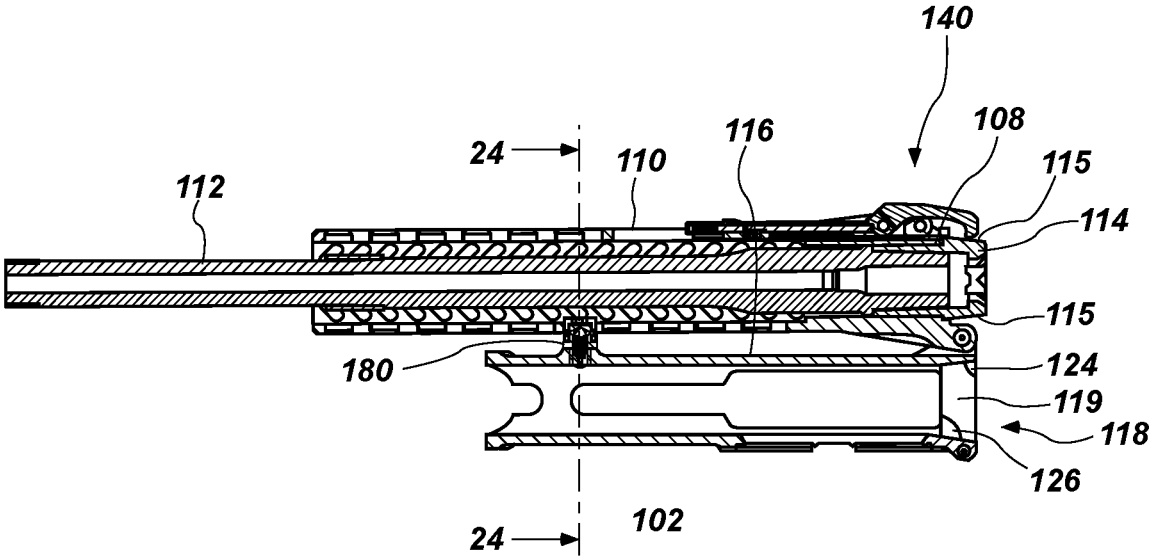
FIG. 4 is a top cross-sectional plan view of the upper receiver, forearm, and barrel, of the firearm in the folded configuration of FIG. 3.

As can be seen in FIG. 4, the barrel 112 is not secured to the upper receiver 102 by complementary threads. In other words, the barrel 112 is not directly threaded to the upper receiver 102. Furthermore, the distal end 118 of the upper receiver 102 does not include threads that are concentric to the barrel 112 and configured to receive a conventional barrel nut, as do AR-style firearms generally conforming to U.S. military specifications.

Figure 5:
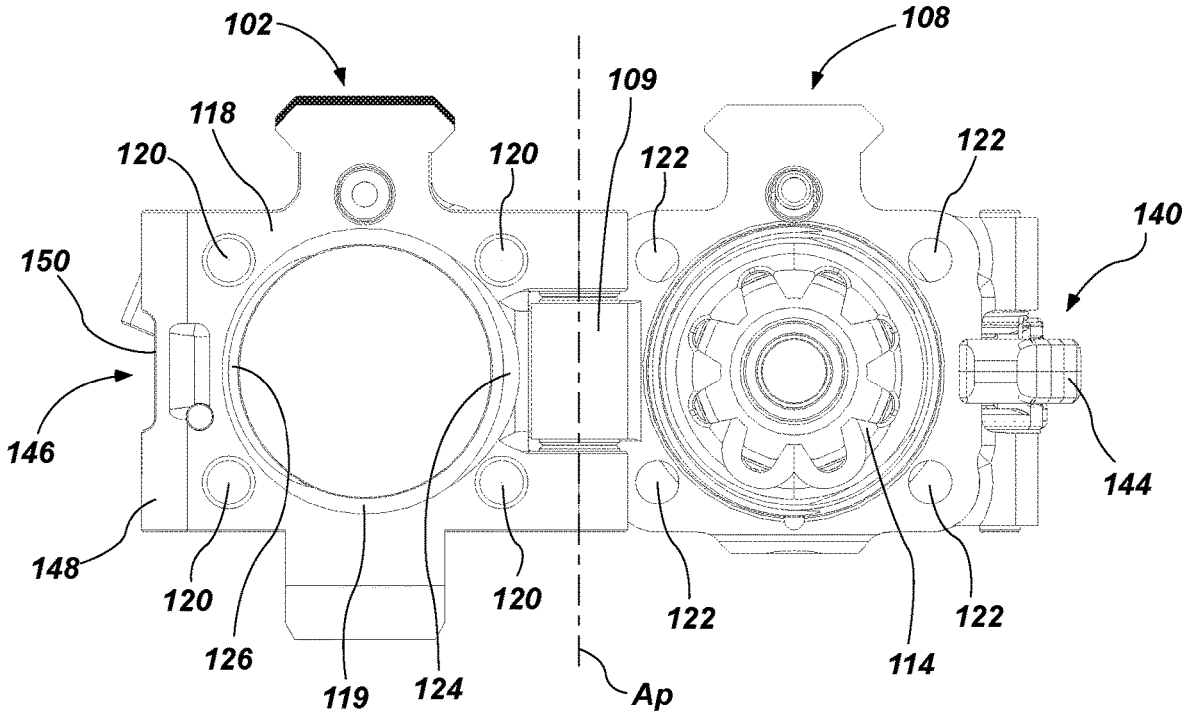
FIG. 5 is an end view of the upper receiver, forearm, and barrel extension of the firearm in the folded configuration.

Referring to FIG. 5, the forearm 108 is pivotally attached to the upper receiver 102 by a pivot pin 109 or other hinge or hinge mechanism, such that the forearm 108 can pivot laterally in a horizontal plane relative to the upper receiver 102 about a pivot axis $A_p$. The pivot pin 109 is shown in the left-hand side of the firearm 100 (from the perspective of a user) in the figures, although the pivot pin 109 may be disposed on either side of the firearm 100. As also shown in FIG. 5, optionally, the upper receiver 102 may include one or more threaded bolt holes 120 (see also FIG. 1) and the forearm 108 may include complementary bolt holds 122 to allow the forearm 108 to be bolted to the upper receiver 102 using bolts, in addition to or instead of using the locking mechanism 140.

In some embodiments, the barrel extension 114 has a frustoconical outer side surface 115 (FIGS. 3 and 4), and the distal end 118 of the upper receiver 102 has a complementary-shaped frustoconical inner surface 119 configured to abut against the frustoconical outer side surface 115 of the barrel extension 114 in the assembled configuration of the firearm 100 shown in FIG. 1. These frustoconical surfaces 115, 119 ensure alignment and mating of the barrel extension 114 (and the barrel 112 attached thereto) to the upper receiver 102.

Figure 6:
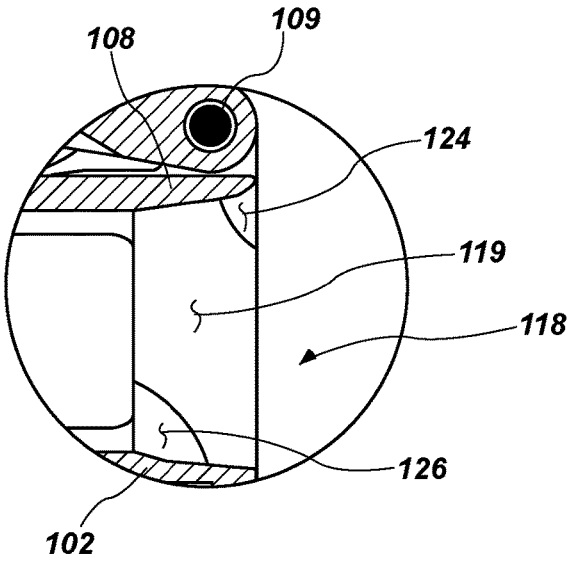
FIG. 6 is an enlarged view of a portion of FIG. 4 illustrating a portion of the distal end of the upper receiver that receives the barrel extension therein when the firearm is in the unfolded, operational configuration.

Furthermore, as can be seen in FIGS. 5 and 6, relief surfaces 124, 126 (see also FIG. 4) are formed in the lateral left and right hand portions of the frustoconical inner surface 119 of the upper receiver 102 to provide clearance for the barrel extension 114 as the barrel extension 114 is pivoted (together with the forearm 108 and barrel 112) from the folded configuration (of FIGS. 2-4) into the assembled configuration of FIG. 1. In other words, the relief surfaces 124, 126 are surfaces of the upper receiver 102 that are relieved relative to the frustoconical inner surface 119 of the upper receiver 102. The relief surfaces 124, 126 may have a toroidal shape, a planar shape, or any other suitable shape that provides the clearance needed to allow the barrel extension 114 to pivot relative to the upper receiver 108 into and out from the assembled position, as discussed below. A first relief surface 124 may be formed in the lateral portion of the frustoconical inner surface 119 of the upper receiver 102 that is located adjacent the pivot pin 109. This first relief surface 124 may be disposed adjacent and intersect the distal end of the frustoconical inner surface 119 of the upper receiver 102. A second relief surface 126 may be formed in the lateral portion of the frustoconical inner surface 119 of the upper receiver 102 that is located on the side thereof opposite the pivot pin 109. This second relief surface 126 may be disposed adjacent and intersect the proximal end of the frustoconical inner surface 119 of the upper receiver 102. Without these relief surfaces 124, 126, the barrel extension 114 would abut against or bind with the distal end 118 of the upper receiver 102 before the barrel extension 114 could reach the fully seated position in the upper receiver 102.

In additional embodiments, the barrel extension 114 may include relief surfaces (in addition to, or in place of, the relief surfaces 124, 126) to provide the clearance needed to allow the barrel extension 114 to pivot relative to the upper receiver 102 into and out from the assembled position.

In the unfolded, assembled configuration, the frustoconical outer side surface 115 of the barrel extension 114 is squeezed tightly against the complementary-shaped frustoconical inner surface 119 of the upper receiver 102 by the locking mechanism as described hereinbelow, and a small gap (e.g., a gap of between about 0.002 in. and about 0.010 in.) may exist between the upper receiver 102 and the forearm 108.

Figure 7:
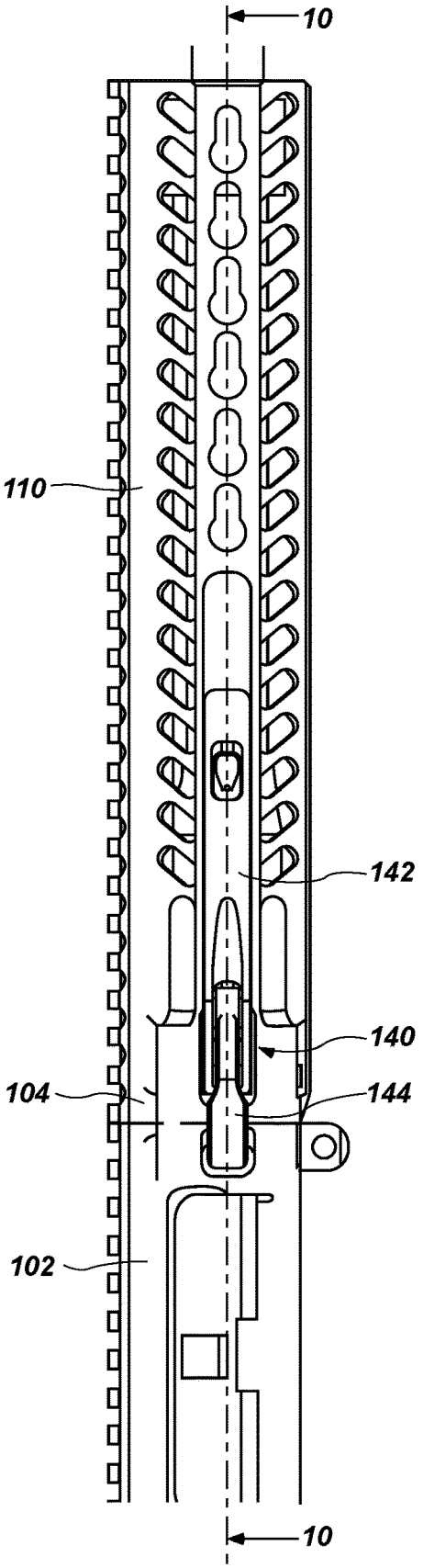
FIG. 7 is a side view of a portion of the firearm in the unfolded, operational configuration and illustrates a locking mechanism of the firearm used to secure the firearm in the unfolded, operational configuration.
Figure 8:
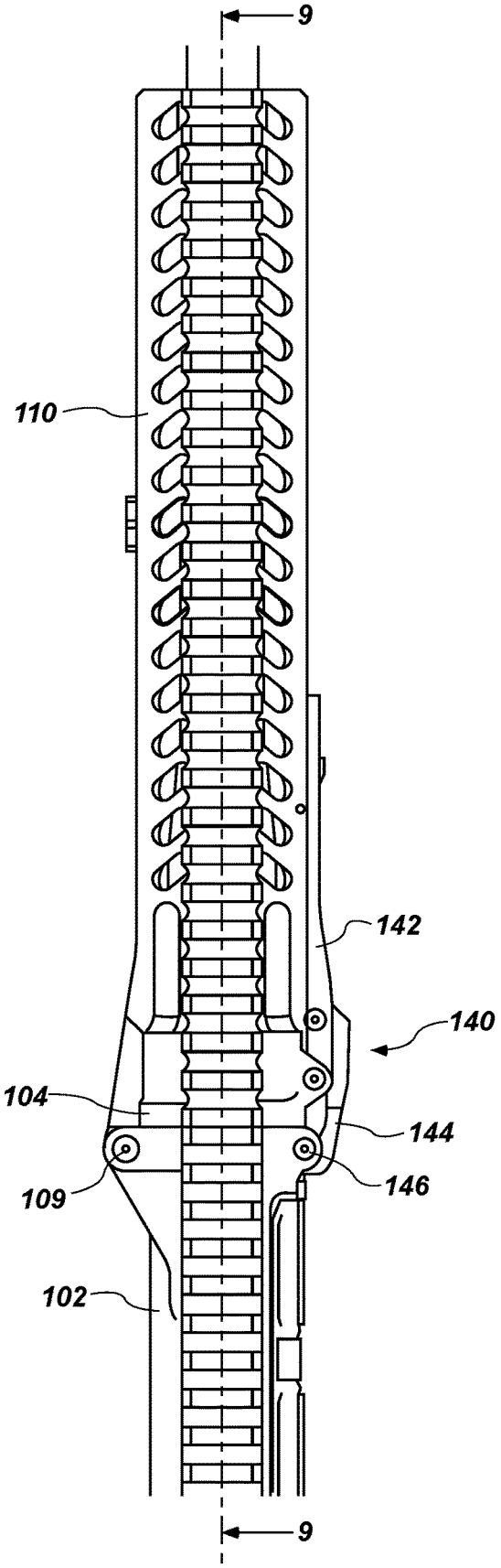
FIG. 8 is a top view of the portion of the firearm illustrated in FIG. 7.
Figure 9:
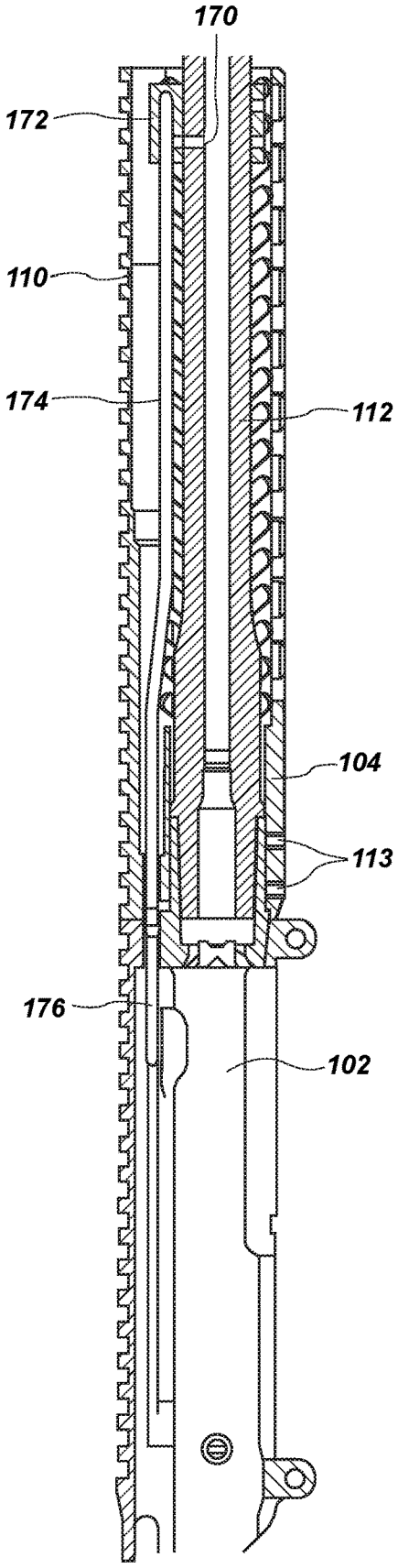
FIG. 9 is a cross-sectional bottom view of the portion of the firearm illustrated in FIGS. 7 and 8 as viewed in the plane of section line 9-9 in FIG. 8.
Figure 10:
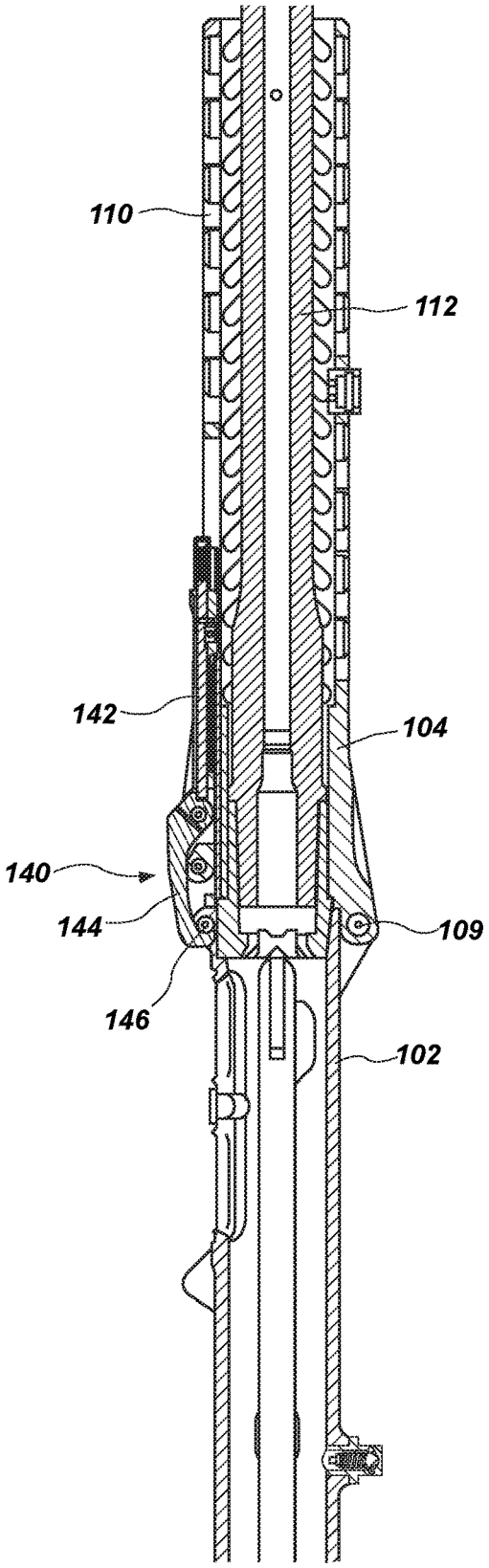
FIG. 10 is a cross-sectional side view of the portion of the firearm illustrated in FIGS. 7 and 9 as viewed in the plane of section line 10-10 in FIG. 7.
Figure 11:
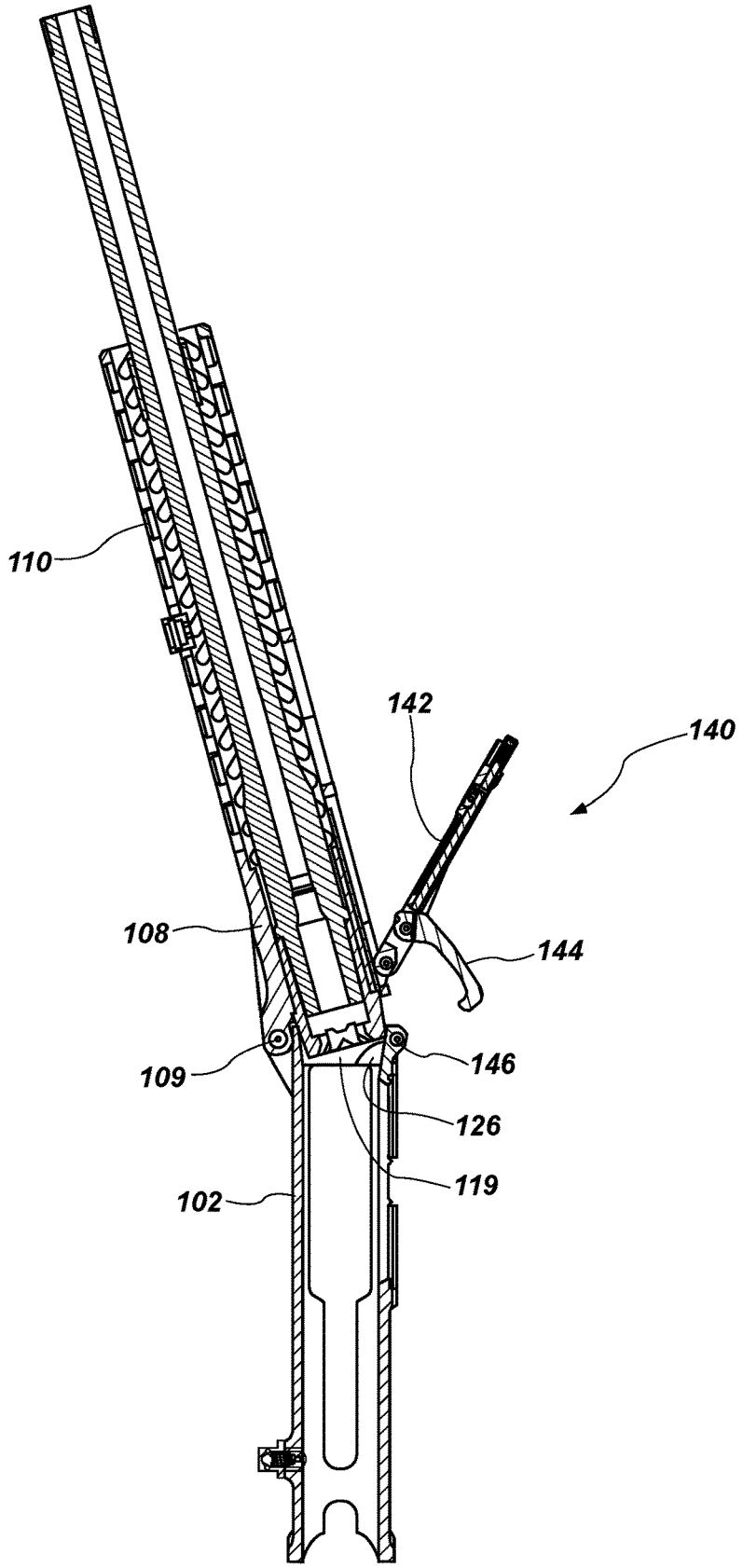
FIG. 11 is a top cross-sectional view of a portion of the firearm in a partially folded configuration.

FIGS. 7 and 8 are side and top views, respectively, of a portion of the firearm 100 in the unfolded, operational configuration (of FIG. 1), and illustrate the locking mechanism 140 of the firearm 100 used to secure the firearm 100 in the unfolded, operational configuration. FIG. 9 is a cross-sectional bottom view of the portion of the firearm 100 as viewed in the plane of section line 9-9 in FIG. 8, and FIG. 10 is a cross-sectional side view of the portion of the firearm 100 as viewed in the plane of section line 10-10 in FIG. 7. FIG. 11 is a cross-sectional view of the upper receiver 102, forearm 108, handguard 110, barrel 112, and barrel extension 114 in the partially folded configuration, at a position at which the relief surfaces 124, 126 accommodate pivoting of the barrel extension 114 into position within the distal end 118 of the upper receiver 102.

Figure 12:
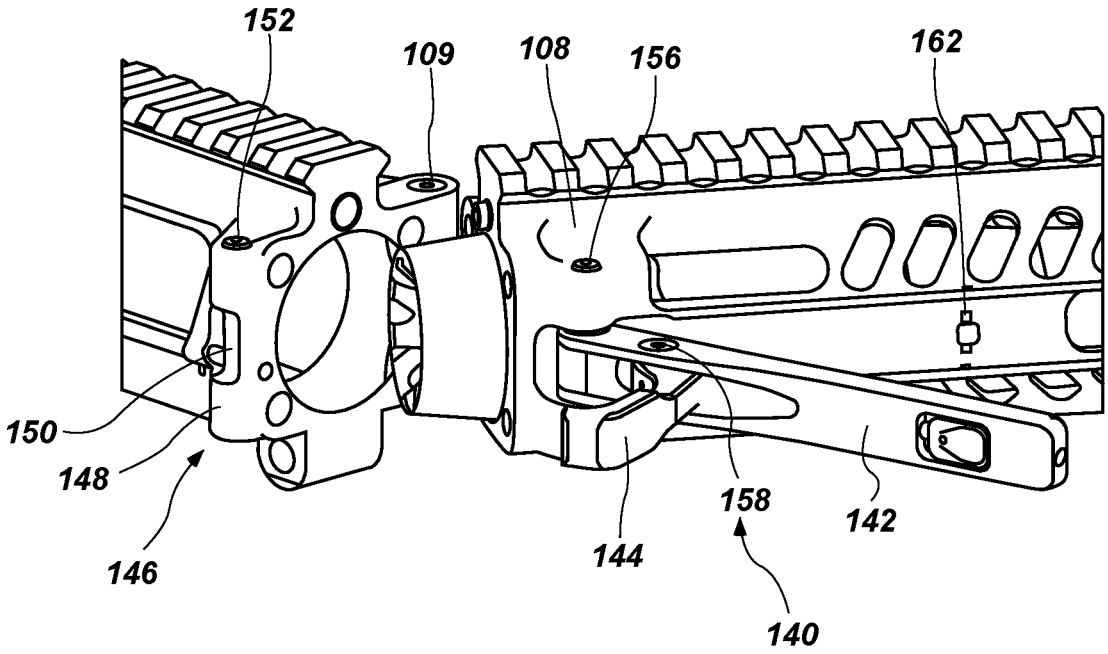
FIGS. 12 and 13 are perspective views used to illustrate and describe how the firearm is unfolded and secured in the operational configuration.

Referring to FIG. 12, the locking mechanism 140 comprises a lever 142 pivotally attached to the forearm 108, and a hook member 144 pivotally attached to the lever 142 and configured to engage a feature 146 on the upper receiver 102. The hook member 144 may be engaged with the feature 146 on the upper receiver 102 and the lever 142 moved relative to the forearm 108 to a locking position to generate a compressive force between the barrel extension 114 and the upper receiver 102 and to secure the forearm 108, barrel 112, and barrel extension 114 to the upper receiver 102 in the assembled position. The feature 146 on the upper receiver 102 that is engaged by the hook member 144 may comprise, for example, a reinforced surface or wall of the upper receiver 102.

Figure 13:
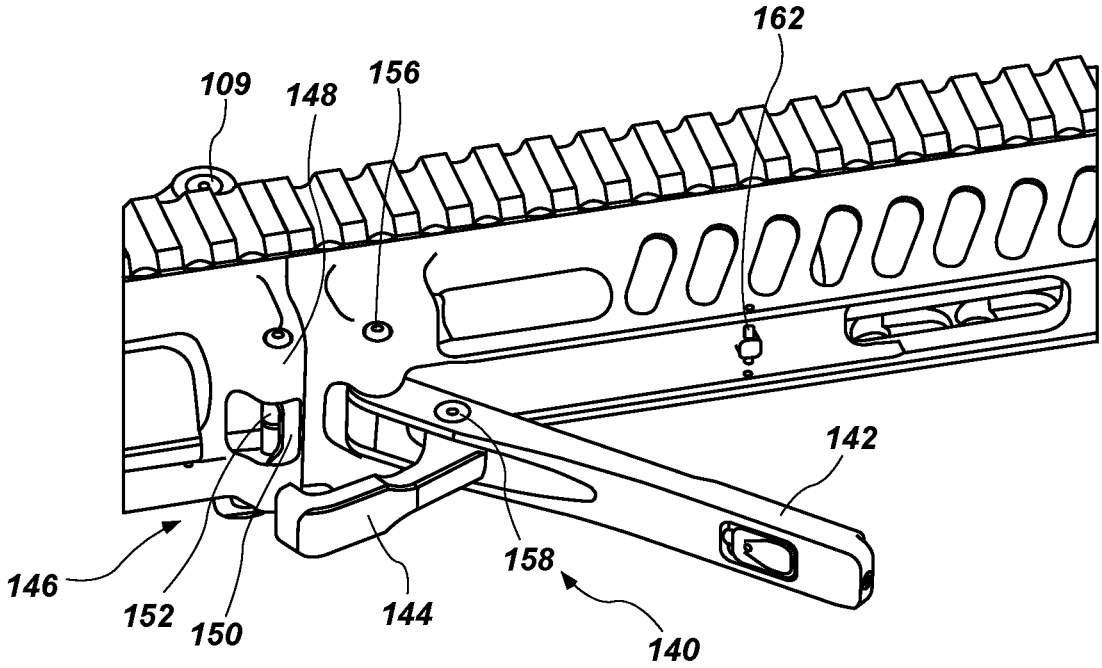
Figure 14:
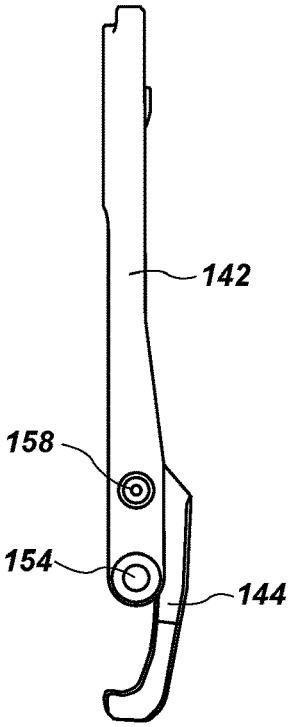
FIG. 14 is a top view of components of a locking mechanism used to secure the firearm in the unfolded and operational configuration in the locked configuration.
Figure 15:
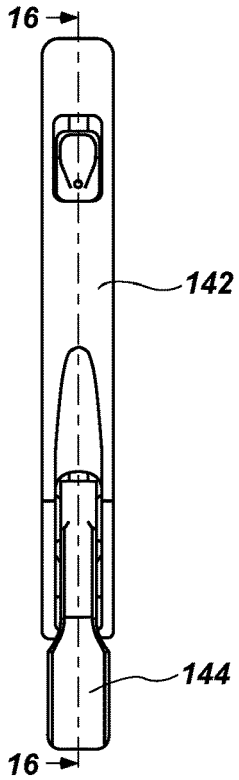
FIG. 15 is a side view of the components of FIG. 14.

For example, referring to FIGS. 12 and 13, the distal end 118 of the upper receiver 102 may include a protrusion 148 (see also FIG. 5) on the side thereof opposite the hinge pin 109 to allow the hook member 144 of the locking mechanism 140 to engage and retain the forearm 108 to the upper receiver 102. The protrusion 148 may optionally have a recess 150 (see also FIG. 5) formed therein, and a pin 152 extending vertically within the recess 150, and the hook member 144 may engage the pin 152 within the recess 150 in the protrusion 148 when the locking mechanism 140 secures the forearm 108 to the upper receiver 102 in the assembled configuration.

FIGS. 14-17 illustrate the lever 142 and other components of the locking mechanism 140 that are carried by the lever 142. One end of the lever 142 includes an aperture 154 through which a pin 156 extends (FIGS. 12 and 13) so as to pivotally couple the lever 142 to the forearm 108. The hook member 144 is pivotally attached to the lever 142 by a pin 158. The pin 158 may be spaced apart from the pin 156 by between about 0.25 inch and about 2.0 inches.

Figure 19:
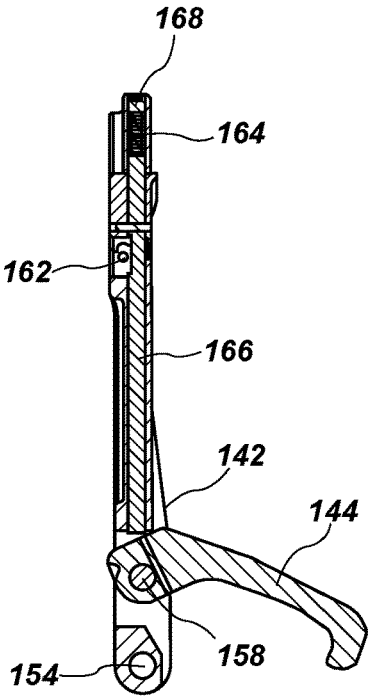
FIG. 19 is a cross-sectional top view of the components of FIGS. 17 and 18 as viewed in the plane of section line 19-19 in FIG. 18.
Figure 20:
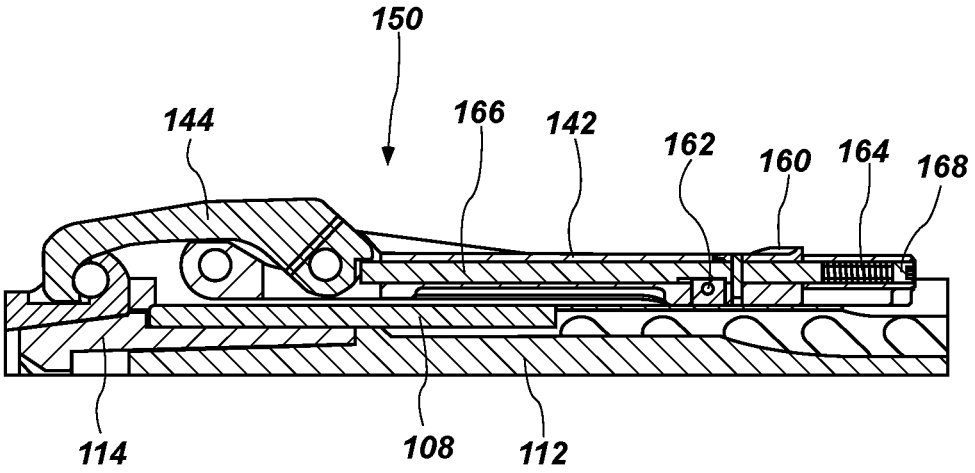
FIG. 20 is an enlarged cross-sectional bottom view of the components of the locking mechanism illustrated in FIGS. 14-19 locking the forearm, barrel, and barrel extension of the firearm to the upper receiver of the firearm in the unfolded and operational configuration of the firearm.
Figure 21:
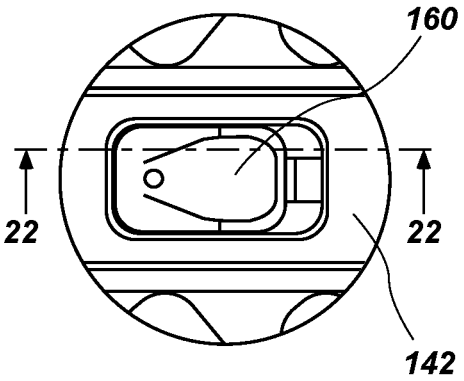
FIG. 21 is an enlarged side view of a portion of the locking mechanism and illustrates a locking retainer of the locking mechanism.
Figure 22:
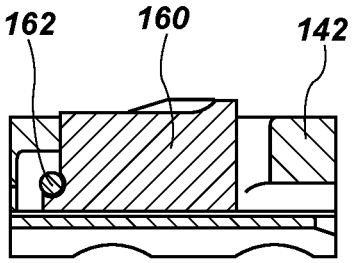
FIG. 22 is an enlarged cross-sectional view illustrating the locking retainer as viewed in the plane of section line 22-22 in FIG. 21 engaging a feature on the forearm so as to retain components of the locking mechanism in a locked configuration of the locking mechanism.

The locking mechanism 140 further includes a retention mechanism for securing the lever 142 in the locking position. The retention mechanism includes a locking retainer 160 carried by the lever 142 and movable relative to the lever 142 between a retaining position and a releasing position. FIG. 20 is an enlarged view illustrating the locking mechanism 140 in the locked position against the forearm 108. In the embodiment of FIGS. 14-20, the locking retainer 160 is disposed partially within the lever 142 and is configured to slide longitudinally relative to the lever 142. A portion of the locking retainer 160 projects through an aperture in the outer, lateral side surface of the lever 142 and is configured for engagement by a thumb or finger of a user, such that the user can cause the locking retainer 160 to move longitudinally relative to the lever 142. FIG. 21 is an enlarged view of the portion of the locking retainer 160 that protrudes through the aperture in the lever 164 (FIG. 20). As shown in FIG. 22, the locking retainer 160 may include a hook or other feature that engages with a retaining feature 162 (FIGS. 12 and 13) on the forearm 108 in the retaining position (and the lever 142 is in the locked position). The retaining feature 162 on the forearm 108 may comprise a pin, protrusion, recess, shoulder, or any other feature that can be engaged by the retaining feature 162 so as to lock the lever 142 in the locked position.

Figure 16:
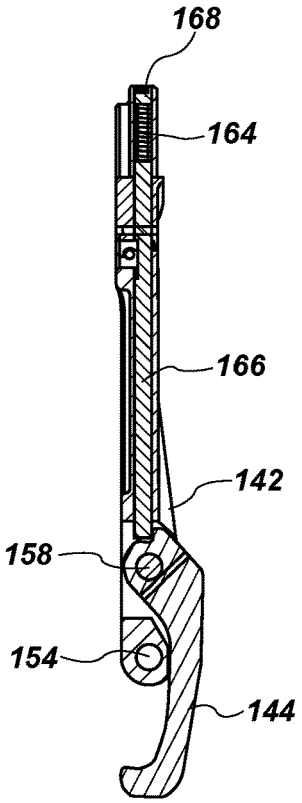
FIG. 16 is a cross-sectional top view of the components of FIGS. 14 and 15 as viewed in the plane of section line 16-16 in FIG. 15.
Figure 17:
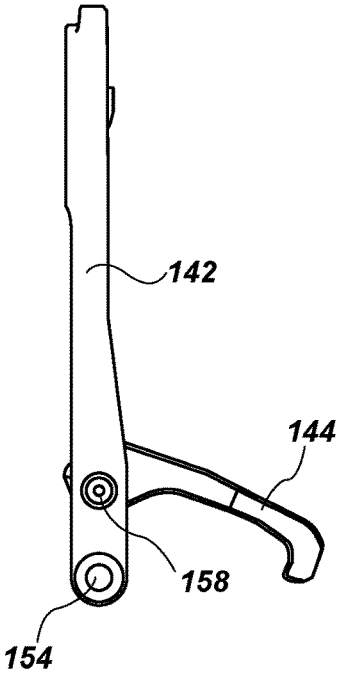
FIG. 17 is a top view of the components of the locking mechanism of FIGS. 14-16 in the unlocked configuration.
Figure 18:
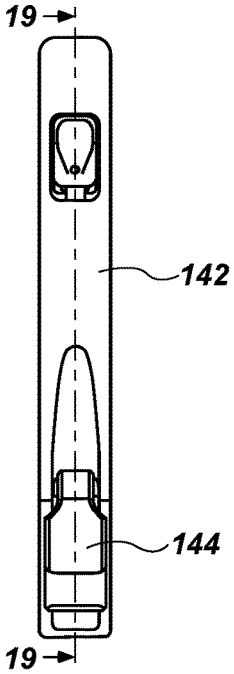
FIG. 18 is a side view of the components of FIG. 17.

Referring again to FIGS. 16 and 19, the retention mechanism further includes a spring 164 biasing the locking retainer 160 to the retaining position relative to the lever 142. The locking retainer 160 may be moved against a force of the spring 164 by a user from the retaining position (FIGS. 14-16) to a releasing position (FIGS. 17-19) to release the retention mechanism and allow unlocking of the locking mechanism 140. The retention mechanism may further include a pin 166 that extends longitudinally within the lever 142. The pin 166 provides a guide along which the locking retainer 160 slides within the lever 142. The pin 166 may also be configured to slide in the longitudinal direction within the lever 142, and may be biased by the spring 164 such that one end of the pin 166 engages the hook member 144. The hook member 144 may include a shoulder or other feature thereon that is engaged by the end of the pin 166 when the hook member 144 and lever 142 are in the locked position, as shown in FIG. 16. In such a configuration, when the firearm 100 is in the folded position (of FIGS. 2-4), the locking mechanism 140 can be placed in the locked position, and the retention mechanism will secure the lever 142 and hook member 144 in place against the forearm 108 so as to prevent the locking hook member 144 from swinging freely when the firearm 100 is in the folded position. A set screw 168 may be used to secure the spring 164, pin 166, and locking retainer 160 within the lever 142, as shown in FIGS. 16 and 19.

In some embodiments, a spring member, such as a wire spring member, may be mounted around the pin 156 (FIG. 13) and may urge the lever 142 to pivot inward toward the forearm 108 (i.e., toward the locked position of the lever 142). Furthermore, a spring member, such as a wire spring member, may be mounted around the pin 158 and may be located and configured to urge the hook member 144 to pivot outward relative to the lever 142 when the locking mechanism is disengaged. The lever 142 and/or the forearm 108 may include a machined boss, shoulder, or other feature that prevents the lever 142 from pivoting outward from the forearm 108 by more than a predetermined angle, which may be in a range extending from about 30° to about 60° (e.g., about) 45°). Similarly, the locking hook 144 and/or the lever 142 may include a machined boss, shoulder, or other feature that prevents the locking hook 144 from pivoting outward relative to the lever 142 by more than a predetermined angle, which may be in a range extending from about 30° to about 60° (e.g., about 45°).

As in the embodiment illustrated in the figures, the firearm 100 may be an automatic or semiautomatic rifle, and may be an AR-style rifle having a conventional bolt carrier group disposed within the receiver. Referring again to FIG. 9, in such embodiments, the barrel 112 may include a gas port 170 extending through the barrel 112 from an inner bore of the barrel 112. A gas block 172 may be mounted to the barrel 112 over the gas port 170. To accommodate the folding of the forearm 108 relative to the upper receiver 102, the firearm 100 may further include both a forward gas tube 174 extending between the gas block 172 and the forearm 108, and a rear gas tube 176 mounted to the upper receiver 102. Upon firing a round of ammunition in the firearm 100, expanding gas within the barrel 112 travels through the gas port 170 in the barrel 112, through the gas block 172, through the forward gas tube 174, and through the rear gas tube 176 and acts upon the bolt carrier group within the upper receiver 102 so as to cause cycling of the bolt carrier group, which results in discharge of a spent casing of the round of ammunition and reloading of another round of ammunition into a firing chamber within the barrel 112.

Figure 23:
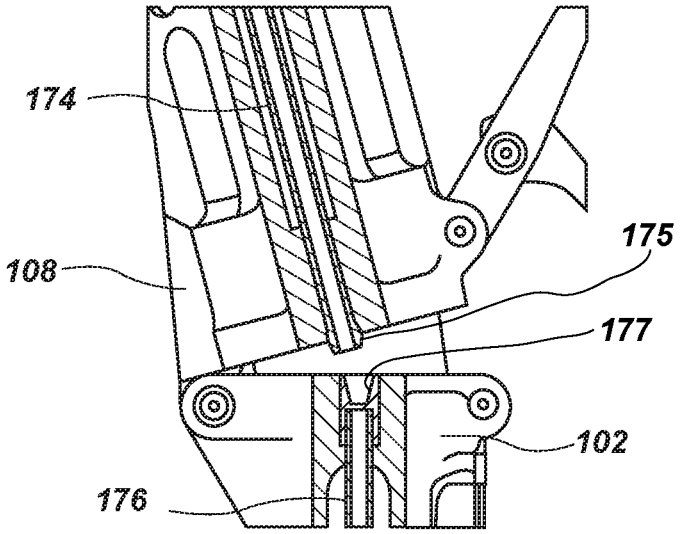
FIG. 23 is a top cross-sectional view of a portion of the firearm taken in a plane extending along a gas tube of the firearm.

FIG. 23 is an enlarged view illustrating the ends of the forward gas tube 174 and the rear gas tube 176 that adjoin one another when the firearm 100 is in the unfolded, assembled configuration (FIG. 1). FIG. 23, however, illustrates the forward gas tube 174 and the rear gas tube 176 while the forearm 108 is partially folded relative to the upper receiver 102. In some embodiments, the adjoining ends of the forward gas tube 174 and the rear gas tube 176 may be configured such that one end is received at least partially into the other end so as to establish an at least substantially gas-tight seal therebetween. For example, one of the forward gas tube 174 and the rear gas tube 176 may include a tapered male gas fitting, and the other of the forward gas tube 174 and the rear gas tube 176 may have a tapered female gas fitting configured to receive the tapered male gas fitting therein when the forearm 108, barrel 112, and barrel extension 114 are in the unfolded, assembled position. In the embodiment illustrated in FIG. 23, the forward gas tube 174 includes a tapered male gas fitting 175, and the rear gas tube 176 includes a complementary tapered female gas fitting 177. The fittings 175, 177 may be secured to the gas tubes 174, 176, respectively, by brazing, welding, threading, etc. The upper receiver 102 includes a receptacle hole in which the tapered female gas fitting 177 and/or rear gas tube 176 is attached. In some embodiments, the receptacle hole may be threaded, and the tapered female gas fitting 177 and/or rear gas tube 176 may include complementary threads. In other embodiments, the tapered female gas fitting 177 and/or rear gas tube 176 may be press-fit, brazed, or welded in place within the upper receiver 102.

In yet additional embodiments, one of the adjoining ends of the forward gas tube 174 and the rear gas tube 176 may have a flared female end, and the other of the adjoining ends of the forward gas tube 174 and the rear gas tube 176 may simply be a straight-walled end of the respective tube 174, 176, and may be received into the flared female end of the other tube 174, 176.

In other embodiments, the adjoining ends of the forward gas tube 174 and the rear gas tube 176 may not have a male-female junction, and may simply abut against one another. In such embodiments, one or more gas-seal members, such as O-rings, may be used to establish an at least substantially gas-tight seal between the adjoining ends of the gas tubes 174, 176.

Figure 24:
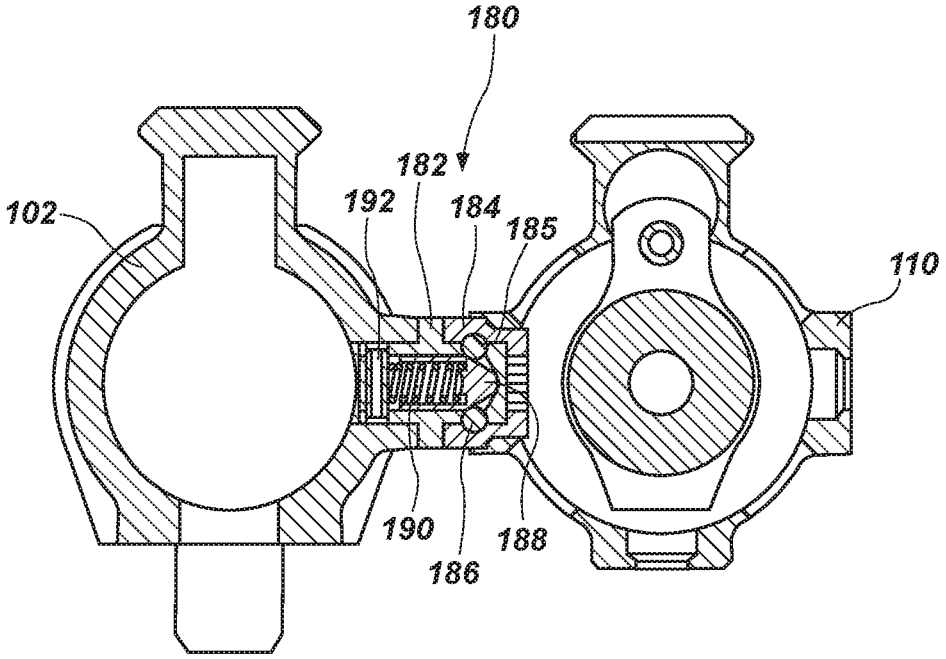
FIG. 24 is a cross-sectional view of the firearm as viewed in the plane of section line 24-24 in FIG. 4 and illustrates a retention mechanism for retaining the forearm, barrel, and barrel extension in fixed position relative to the receiver in the folded configuration.

Referring again to FIG. 4, in some embodiments, the firearm 100 may include a retention mechanism for retaining the forearm 108, barrel 112, and barrel extension 114 in fixed position relative to the upper receiver 102 in the folded position (FIGS. 2-4). As a non-limiting example, such a retention mechanism may comprise a snap device 180 that includes a male plug and a complementary female socket, one of which may be disposed on either the forearm 108 or handguard 110, and the other of which may be disposed on the upper receiver 102 or the stock 106. FIG. 24 is an enlarged cross-sectional view of the plane identified by section line 24-24 in FIG. 4. As shown therein, the snap device 180 may include a male plug assembly 182 disposed on the upper receiver 102 and a complementary female socket 184 disposed on the handguard 110. The male plug assembly 182 includes partially exposed bearings 186 that secure the male plug assembly 182 within the female socket 184. The female socket 184 includes a bearing recess 185 for receiving the bearings 186 therein. The male plug assembly 182 includes a plunger 188, which exerts a radial outward force on the bearings 186 so as to secure the bearings 186 within the bearing recess 185 in the female socket 184. The male plug assembly 182 further includes a spring 190, which acts on the plunger 188 and, hence, the bearings 186. A roll pin 192 may be used to secure the spring 190 and plunger 188 inside the male plug assembly 182.

The male plug assembly 182 may be threaded onto (or otherwise attached to) the upper receiver 102, and the female socket 184 may be threaded onto (or otherwise attached to) the handguard 110, or vice versa. The snap device 180 enables a snap connection to be made between the upper receiver 102 and the handgaurd 110, thus allowing the forearm 108, handguard 110, barrel 112, and barrel extension 114 to be rigidly connected to the upper receiver 102 when the firearm 100 is in the folded configuration.

In yet further embodiments, the present disclosure includes an adapter that may be used with an AR style upper and a handguard or forearm to provide a folding mechanism as described herein. In particular, such an adapter may include a first subassembly that is configured to be threaded, bolted, or otherwise attached to an AR style upper, and the first subassembly may include the features of the distal end 118 of the upper receiver 102 described herein. The adapter may include a second subassembly that is configured to be threaded, bolted, or otherwise attached to a handguard or forearm and barrel. The second subassembly may include the features of the locking mechanism 140 as described herein. The first and second subassemblies may be hingedly attached to one another using, for example, the pivot pin 109 as described hereinabove. Thus, using such an adapter, an AR style firearm may be configured to fold as described herein.

Embodiments of firearms 100 as described herein may be conveniently stored and transported in the folded configuration. When it is desired to use the firearm 100, the forearm 108, barrel 112, and barrel extension 114 may be secured to the upper receiver 102 in the assembled position of FIG. 1 using the locking mechanism 140. One or more rounds of ammunition may be fired using the firearm 100. When it is desired to store and/or transport the firearm 100, the locking mechanism 150 may be unlocked, and the forearm 108, barrel 112, and barrel extension 114 may be folded relative to the upper receiver 102 from the assembled position of FIG. 1 to the folded position of FIGS. 2-4. It may be necessary or desirable to lock the bolt carrier group in the retracted position using the bolt catch in order to fold and unfold the firearm 100.

The example embodiments of the disclosure described above do not limit the scope of the invention, since these embodiments are merely examples of embodiments of the invention, which is defined by the scope of the appended claims and their legal equivalents. Any equivalent embodiments are intended to be within the scope of this invention. Indeed, various modifications of the disclosure, in addition to those shown and described herein, such as alternative useful combinations of the elements described, will become apparent to those skilled in the art from the description. Such modifications and embodiments are also intended to fall within the scope of the appended claims.

What is claimed is:

1. A firearm, comprising:

a receiver;

a forearm pivotally attached to a distal end of the receiver; and a barrel having a barrel extension, a proximal end of the barrel and barrel extension secured within the forearm such that the barrel and barrel extension are laterally pivotable with the forearm relative to the receiver between a first assembled position and a second folded position;

wherein the barrel is not secured to the receiver by complementary threads.

2. The firearm of claim 1, wherein the distal end of the receiver includes a frustoconical surface located and configured to receive the barrel extension therein when the forearm, barrel, and barrel extension are in the first assembled position.

3. The firearm of claim 2, wherein the distal end of the receiver further includes at least one relief surface intersecting the frustoconical surface of the distal end of the receiver, the relief surface located and configured so as to provide clearance between the barrel extension and the distal end of the receiver as the forearm, barrel and barrel extension are pivoted from the second folded position to the first assembled position.

4. The firearm of claim 1, further comprising a locking mechanism for securing the forearm, barrel, and barrel extension to the receiver in the first assembled position, wherein the receiver comprises an upper receiver and a lower receiver.

5. The firearm of claim 4, wherein the locking mechanism comprises:

a lever pivotally attached to the forearm;

a hook member pivotally attached to the lever and configured to engage a feature on the receiver;

wherein the hook member may be engaged with the feature on the receiver and the lever moved relative to the forearm to a locking position to generate a compressive force between the barrel extension and the receiver and to secure the forearm, barrel, and barrel extension to the receiver in the first assembled position.

6. The firearm of claim 5, further comprising a retention mechanism for securing the lever in the locking position.

7. The firearm of claim 6, wherein the retention mechanism comprises:

a locking retainer carried by the lever and movable relative to the lever; and a spring biasing the locking retainer to a retaining position relative to the lever; and wherein the locking retainer engages with a retaining feature on the forearm in the retaining position, and wherein the locking retainer may be moved against a force of the spring by a user from the retaining position to a releasing position to release the retention mechanism and allow unlocking of the locking mechanism.

8. The firearm of claim 1, wherein the barrel extension projects outwardly in the proximal direction from a proximal end of the forearm.

9. The firearm of claim 1, wherein the firearm is an automatic or semiautomatic rifle, and wherein the barrel includes a gas port extending through the barrel from an inner bore of the barrel, the firearm further comprising:

a bolt carrier group disposed within the receiver;

a gas block mounted to the barrel over the gas port;

a forward gas tube extending between the gas block and the forearm; and a rear gas tube mounted to the receiver; and wherein, upon firing a round of ammunition in the firearm, expanding gas within the barrel travels through the gas port in the barrel, through the gas block, through the forward gas tube, and through the rear gas tube and acts upon the bolt carrier group within the receiver so as to cause cycling of the bolt carrier group, cycling of the bolt carrier group resulting in discharge of a spent casing of the round of ammunition and reloading of another round of ammunition into a firing chamber within the barrel.

10. The firearm of claim 9, wherein one of the forward gas tube and the rear gas tube has a tapered male gas fitting, and wherein the other of the forward gas tube and the rear gas tube has a tapered female gas fitting configured to receive the tapered male gas fitting when the forearm, barrel, and barrel extension are in the first assembled position.

11. The firearm of claim 1, wherein the proximal end of the barrel is threaded to the barrel extension, and further comprising at least one set screw extending through the forearm and securing the barrel or barrel extension in fixed position relative to the forearm.

12. The firearm of claim 1, further comprising a handgaurd secured to the forearm and extending over and around at least a portion of the barrel.

13. The firearm of claim 1, further comprising a retention mechanism for retaining the forearm, barrel, and barrel extension in fixed position relative to the receiver in the second folded position.

14. A method of using a firearm as recited in claim 1, comprising:

securing the forearm, barrel, and barrel extension to the receiver in the first assembled position;

firing one or more rounds of ammunition using the firearm; and folding the forearm, barrel, and barrel extension relative to the receiver from the first assembled position to the second folded position.

15. A method of manufacturing a firearm, comprising:

providing a receiver having a distal end;

providing a barrel having a barrel extension;

securing a proximal end of the barrel and the barrel extension to a forearm; and pivotally attaching the forearm to the distal end of the receiver, such that the barrel and barrel extension are laterally pivotable with the forearm relative to the receiver between a first assembled position and a second folded position.

16. The method of claim 15, wherein providing the receiver comprises forming a frustoconical surface at a distal end of the receiver, the frustoconical surface located and configured to receive the barrel extension therein when the forearm, barrel, and barrel extension are in the first assembled position, and forming at least one relief surface intersecting the frustoconical surface of the distal end of the receiver, the relief surface located and configured so as to provide clearance between the barrel extension and the distal end of the receiver as the forearm, barrel and barrel extension are pivoted from the second folded position to the first assembled position.

17. The method of claim 15, further comprising providing a locking mechanism for securing the forearm, barrel, and barrel extension to the receiver in the first assembled position, wherein the receiver comprises an upper receiver and a lower receiver.

18. The method of claim 15, further comprising configuring the barrel extension to project outwardly in the proximal direction from a proximal end of the forearm.

19. The method of claim 15, wherein the firearm is an automatic or semiautomatic rifle, and wherein the barrel includes a gas port extending through the barrel from an inner bore of the barrel, the method further comprising:

disposing a bolt carrier group within the receiver;

mounting a gas block to the barrel over the gas port;

providing a forward gas tube extending between the gas block and the forearm; and mounting a rear gas tube to the receiver.

20. The method of claim 15, further comprising threading the proximal end of the barrel to the barrel extension, and securing the barrel or barrel extension in fixed position relative to the forearm using at least one set screw.

* * * * *